United States Patent [19]

Laney

[11] Patent Number: 4,788,873

[45] **Date of Patent: * Dec. 6, 1988**

[54] PORTABLE WALKING BEAM PUMP JACK

[76] Inventor: Roy N. Laney, 1007 Rebecca Rd., Frederick, Okla. 73542

[ * ] Notice: The portion of the term of this patent subsequent to Feb. 25, 2003 has been disclaimed.

[21] Appl. No.: 933,181

[22] Filed: Nov. 21, 1986

Related U.S. Application Data

[63] Continuation of Ser. No. 832,480, Feb. 20, 1985, abandoned, which is a continuation of Ser. No. 434,725, Oct. 18, 1982, Pat. No. 4,572,012.

[51] Int. Cl.[4] ..... F16H 21/32

[52] U.S. Cl. ..... 74/41; 173/23; 254/423; 280/764.1

[58] Field of Search ..... 74/41; 52/126.1, 126.4, 52/126.6, 126.7, 122.1; 280/763.1, 764.1, 765.1; 173/23, 28; 254/418, 423, 424

[56] References Cited

U.S. PATENT DOCUMENTS

| | | | |
|---|---|---|---|
| 121,120 | 11/1871 | Nelson | 74/41 |
| 279,950 | 6/1883 | Jewett | 254/424 X |
| 295,413 | 3/1884 | Martin | 173/28 |
| 795,534 | 7/1905 | McCain | 173/28 |
| 1,621,636 | 3/1927 | Lane et al. | 173/23 |
| 2,084,686 | 6/1937 | Howard | 173/23 |
| 2,516,182 | 7/1950 | Bury | 173/28 |
| 2,519,364 | 8/1950 | Fredholm | 254/424 |
| 2,523,444 | 9/1950 | Moseley | 74/41 |
| 2,732,197 | 1/1956 | Cornett | 173/23 |
| 2,904,310 | 9/1959 | Leonard | 173/28 X |
| 2,939,681 | 6/1960 | Owen | 255/19 |
| 2,968,841 | 1/1961 | Vance | 52/126.7 |
| 3,003,787 | 10/1961 | Woolslayer et al. | 280/764.1 |
| 3,321,182 | 5/1967 | Elenburg | 254/423 X |
| 3,364,755 | 1/1968 | Miller | 74/41 |
| 3,406,581 | 10/1968 | Eyler et al. | 74/41 |
| 3,438,450 | 4/1969 | Failing | 173/28 X |
| 3,442,531 | 5/1969 | Rutledge | 280/765.1 |
| 3,621,723 | 11/1971 | Miller | 74/41 |
| 3,700,047 | 10/1972 | Gartner | 173/28 |
| 3,844,582 | 10/1974 | Cook | 280/764.1 |
| 3,860,216 | 1/1975 | Brown | 254/423 |
| 3,867,846 | 2/1975 | Cambern | 74/41 |
| 3,924,876 | 12/1975 | Vaillant et al. | 280/764.1 |
| 4,216,939 | 8/1980 | Valdespino | 254/423 X |
| 4,321,837 | 3/1982 | Grigsby | 74/41 |
| 4,324,077 | 4/1982 | Woolslayer | 173/23 |
| 4,336,840 | 6/1982 | Bailey | 173/28 |
| 4,375,892 | 3/1983 | Jenkins | 173/23 |
| 4,401,408 | 8/1983 | Gibert | 254/423 X |
| 4,569,422 | 2/1986 | Hoffman | 280/764.1 |
| 4,572,012 | 2/1986 | Laney | 74/41 |

FOREIGN PATENT DOCUMENTS

| | | | |
|---|---|---|---|
| 1215223 | 12/1970 | United Kingdom | 280/765.1 |

*Primary Examiner*—Lawrence Staab
*Assistant Examiner*—Dwight G. Diehl
*Attorney, Agent, or Firm*—Laney, Dougherty, Hessin & Beavers

[57] ABSTRACT

A portable walking beam pump jack for use in pumping liquids from an oil well having an elongated frame and an axle with wheels thereon mounted transversely on the frame for providing rolling transportation. Stabilizer pads are provided for securing the frame with respect to a ground location, after transportation. An engine is mounted on the frame and rotates a counterweighted pair of arms which are journalled for rotation adjacent to the frame and parallel to the longitudinal axis of the frame. A drive yoke is connected between the counterweighted arms and a walking beam such that rotation of the arms drives the walking beam in a rocking motion. A foldable support assembly is mounted upon the frame and supports the walking beam. The walking beam can be connected to a sucker rod for pumping from a well. The support assembly is foldable from a first, fixed position in which the walking beam is raised for rocking in a pumping motion to a second, fixed position in which the walking beam is held in a lowered position for transportation. Preferably raising and lowering the support assembly is achieved by means of a hydraulic cylinder which extends from the frame to the support assembly.

6 Claims, 3 Drawing Sheets

PORTABLE WALKING BEAM PUMP JACK

RELATED APPLICATION

This application is a continuation application of U.S. patent application Ser. No. 832,480 entitled "PORTABLE WALKING BEAM PUMP JACK" filed on Feb. 20, 1985, and now abandoned, which application is a continuation of U.S. patent application Ser. No. 434,725 filed on Oct. 18, 1982 and issued to U.S. Pat. No. 4,572,012 on Feb. 25, 1986.

BACKGROUND OF THE INVENTION

1. Field of the Invention

This invention relates in general to walking beam pump jacks and more particularly to walking beam pump jacks for use in oil well pumping and the like.

2. Description of the Prior Art

At the present time there are several types of pumps which are used for pumping liquids from oil and gas wells. These pumps include walking beam pump jacks, hydraulic rod-lifting pumps and down-hole hydraulic pumps. The down-hole hydraulic pumps operate by pumping a motive fluid through a conduit down into a well. The hydraulic fluid drives the mechanism of an elongated pump which resides at a desired depth of the well. Well fluids and the hydraulic fluid are conveyed to the surface in a conduit or conduits separate from that which conveys the hydraulic fluid down to the pump. These down-hole hydraulic pumps are generally used for short term pumping at remote locations.

Another type of pump which has been used for short term, remote location pumping is the hydraulic, rod-lifting pump. These pumps reciprocate a pumping rod, often called a sucker rod, which extends through the well bore from the surface to a desired depth. Attached to the bottom of the sucker rod is a one way valve which lifts liquid on the upstroke and gathers more liquid for lifting on the downstroke. The hydraulic lifter at the surface comprises a horizontally journalled pulley over which a cable extends. The ends of the pulley are connected to hydraulic cylinders which can raise and lower the pulley along a vertical frame. One end of the cable is fixed and the other is attached to the sucker rod so that as the pulley is raised and lowered, the sucker rod is raised and lowered as well.

The hydraulic rod-lifting pump has been made portable by mounting the vertical pulley frame, hydraulic cylinders, and hydraulic pumps on a trailer which can be a towed to a well location. The vertical pulley frame has been pivotally attached so that it can be laid down during transportation. However, heavy pumping loads on the hydraulic cylinders has made these devices short lived. Also, this method of pumping is not as rapid or as efficient as presently available walking beam pump jacks. Accordingly, it has only been used for temporary, remote location pumping.

Walking beam pump jacks are generally used only for longer term pumping at wells which are more accessible. This is because the walking beam pump jacks have heretofore been not easily transported and are more or less permanently affixed to a well location when they are used.

Walking beam pump jacks operate by reciprocating a sucker rod which extends from the surface through a well bore to a one way valve. Reciprocation of the sucker rod pumps liquids in the same manner as the reciprocation of the sucker rod in a hydraulic rod-lifting pump.

The walking beam pump jacks in present use obtain a significant advantage over other pumps by use of a fixed-mount, long-stroke walking beam driven by a counterweighted rotating drive. The walking beam is mounted on a relatively tall support. An assembly for attaching the sucker rod to the walking beam is disposed at one end of the walking beam. Attached to the other end of the walking beam and extending downwardly is a drive yoke which extends from the walking beam to a pair of counterweighted drive arms. These drive arms rotate about an axis at one end of the arms. A diesel or propane engine drives the arms to rotate which, in turn, rocks the walking beam as a result of the motion of the yoke.

The walking beam must be mounted in a relatively high position because there must be room for the yoke and drive arms to extend and rotate beneath one end of the walking beam. The drive arms must be relatively long and counterweighted by a relatively heavy counterweight in order to produce a proper reciprocating stroke of the sucker rods and in order to lift the relatively large weight of the sucker rod string. Because of this relatively large height, conventional walking beam pump jacks can not be transported over most highways. Bridges and other obstructions prevent the transportation of devices as tall as a conventional walking beam pump jack. Moreover, the heavy equipment and frame components have prevented easy transportation of these type of pumps. Therefore, walking beam pump jacks have only been used for long term pumping and the pumps have been assembled at the well cite on more or less permanent foundations.

While walking beam pump jacks are the preferred devices for pumping from most deep wells and oil wells, it has been impossible or uneconomical to use such pumps for short periods or in remote locations. This is because these pumps must be assembled at the well location and are relatively difficult to move.

SUMMARY OF THE INVENTION

It is accordingly an object of the present invention to provide a portable walking beam pump jack unit. It is also an object of the present invention to provide such a portable walking beam pump jack which can be folded to a transportable height and raised to a pumping height.

Yet another object of the present invention is to provide a portable walking beam pump jack which can be quickly and inexpensively moved from one well pumping operation to another.

Still another object of the present invention is to provide an improved walking beam support assembly and an improved walking beam frame and drive assembly.

To achieve these objects, the portable walking beam pump jack of the present invention comprises an elongated frame preferably comprised of a pair of connected, horizontal, spaced apart beams. Ground engaging wheel means, preferably an axle and a set of wheels, are connected to the frame for supporting the frame during transportation over a ground surface. A stabilizing means is attached to the frame for securing the frame with respect to a ground location. Preferably the stabilizing means comprises front and rear pads which can be hydraulically lowered to engage the ground surface and secure the frame with respect to the surface.

The walking beam of the present invention has a first end, a midportion, and a second end, the second end being adapted for connection to a pumping rod. A counterweighted, rotating drive means is mounted on the frame and connected to the first end of the walking beam for rocking the walking beam in a pumping motion. In order to raise and lower the walking beam for pumping and transportation, respectively, a support assembly is foldably mounted on the frame. The midportion of the walking beam is pivotally connected upon the support assembly and is raised and lowered with the support assembly. The support assembly is foldable from a first, fixed position in which the walking beam is supported in a raised position for rocking in a pumping motion to a second, fixed position in which the walking beam is held in a lowered position for transportation.

The support assembly preferably comprises first, second and third legs each having first and second ends. The first ends of the legs are joined at the pivotal connection to the walking beam. The second ends of the first and second legs are pivotally connected to one end of the frame. The second end of the third leg can be connected to either of two locations on the frame. The first position secures the support assembly and walking beam in a raised position for pumping and the second position secures the support assembly and walking beam in a second, lowered position for transportation.

The drive means for the walking beam pump jack of the present invention preferably comprises an engine mounted on the frame and connected to a pair of journalled drive arms which rotate just outside of the parallel beams of the frame.

For a further understanding of the invention, and further objects, features and advantages thereof, reference may now be had to the following description taken in conjunction with the accompanying drawings.

BRIEF DESCRIPTION OF THE DRAWINGS

FIG. 5 is a cross-sectional view of the pump jack taken along lines 5—5 shown in FIG. 2.

FIG. 6 is a cross-sectional view of the pump jack taken along lines 6—6 shown in FIG. 2.

DESCRIPTION OF PREFERRED EMBODIMENTS

Figure 1:
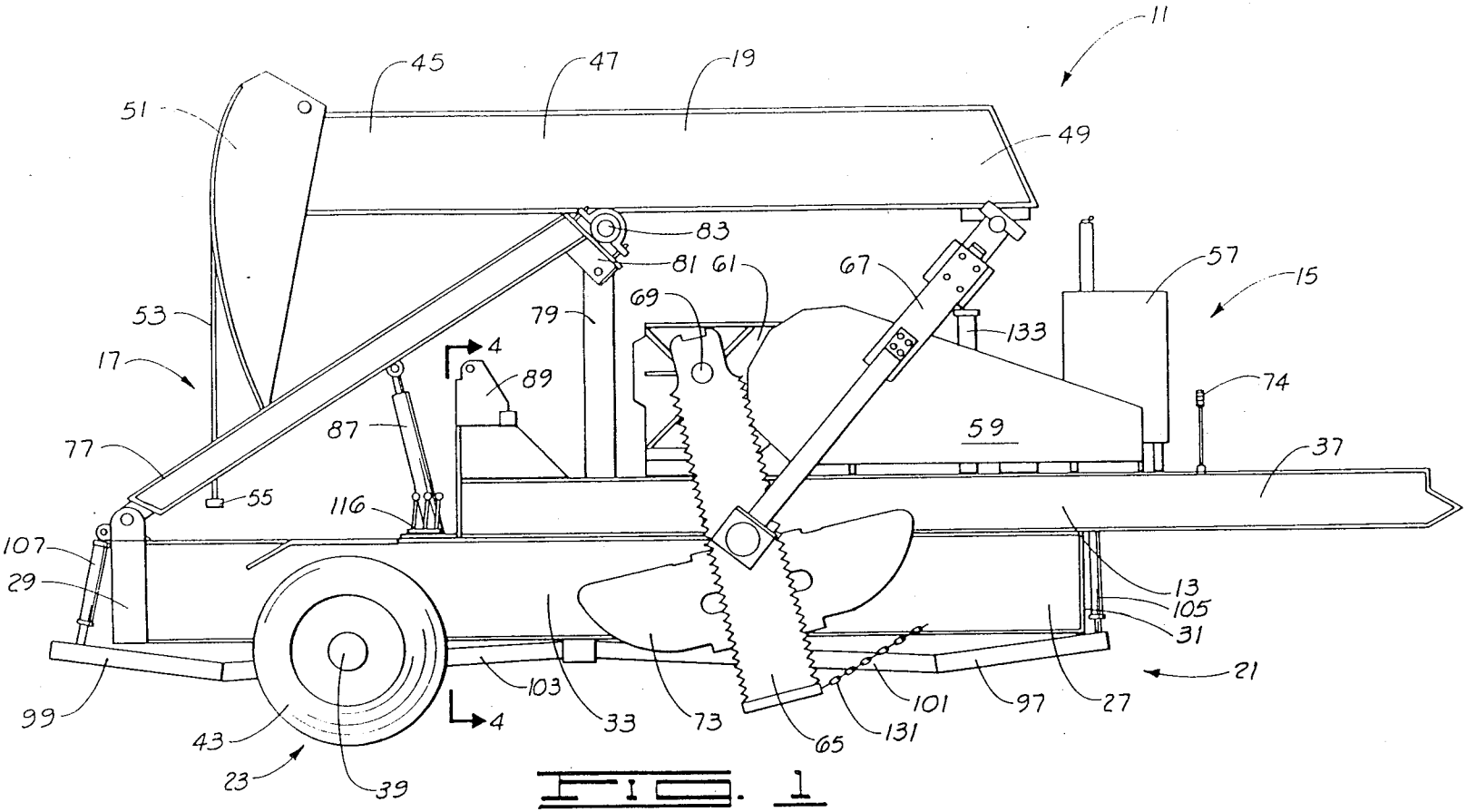
FIG. 1 is a side elevational view of a portable walking beam pump jack constructed in accordance with the present invention.
Figure 2:
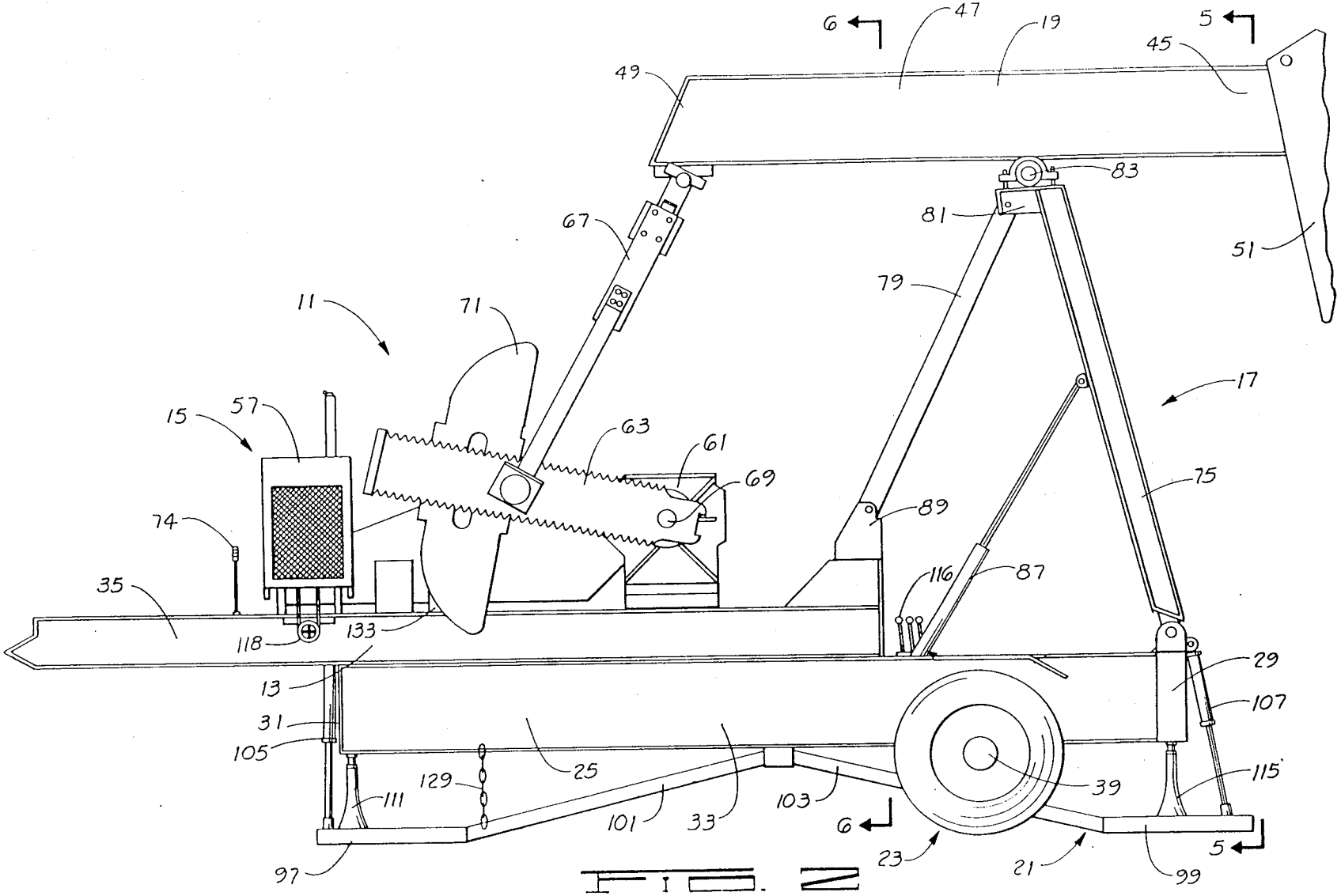
FIG. 2 is a side elevational view of the opposite side of the pump jack of FIG. 1.
Figure 4:
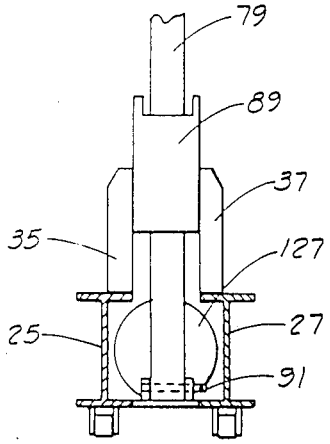
FIG. 4 is a cross-sectional view of the pump jack taken along lines 4—4 shown in FIG. 1.
Figure 1:
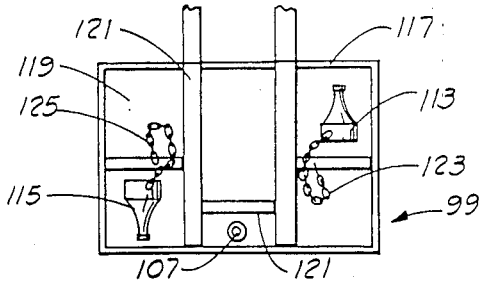
Figure 3:
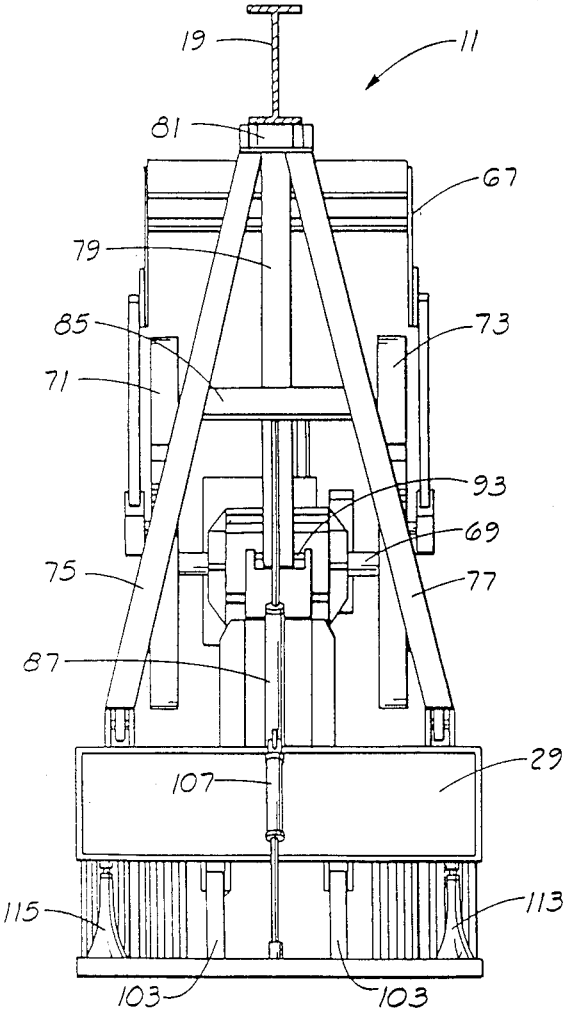
FIG. 3 is a plan view of a pad portion of the pump jack shown in FIGS. 1 and 2.
Figure 2:
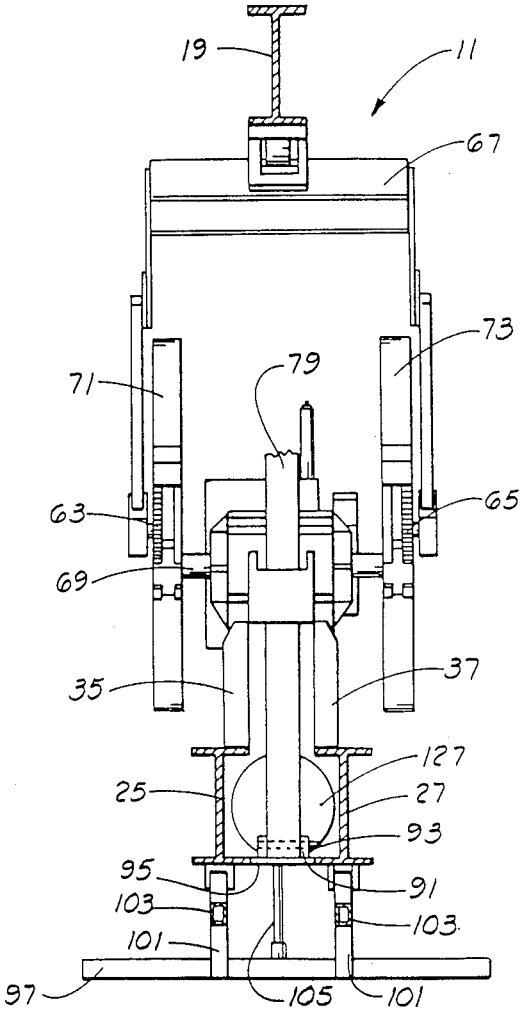

Referring now to FIGS. 1 through 6, the pump jack 11 of the present invention includes a frame 13, a drive assembly 15, a support assembly 17, a walking beam 19, a stabilizing assembly 21 and a wheel assembly 23. The wheel assembly 23 is connected to the frame 13 and supports the pump jack 11 during transportation. The stabilizing assembly 21 is mounted to the bottom of the frame 13 and is movable from a transportation position to a ground engaging position for stabilizing the frame 13 during pumping. The drive assembly 15 is mounted upon the frame 13 and connected to the walking beam 19 to rock the walking beam 19 in a pumping motion. The support assembly 17 is mounted upon the frame 13 and is movable from a first position for pumping to a second fixed position for transportation. The walking beam 19 is pivotally mounted to the top of the support assembly. The walking beam can remain connected to the drive assembly even as it moves between the first, raised pumping position and the second, lowered transport position.

The main frame 13 is comprised of a pair of I-beams 25 and 27. The I-beams 25 and 27 extend horizontally in a spaced apart, parallel relationship. They are disposed for mainly supporting vertical loads. The beams 25 and 27 are connected at their ends by a rear plate 29 and a front plate 31. The front and rear plates 31 and 29 extend transversely to the beams 25 and 27 and these plates and beams, together, form an elongated box 33.

The main frame 13 also includes a second pair of I-beams 35 and 37. These beams are welded or bolted to the top of the beams 25 and 27. The beams 35 and 37 extend horizontally and parallel to each other in a spaced apart relationship. The beams 35 and 37 extend from just behind the middle horizontal axis of the beams 25 and 27 out beyond the front plate 31. The front of the beams 35 and 37 form a cantilevered towing connection extending horizontally from the top of box 33. The beams 35 and 37 also support the drive assembly 15 and a portion of the support assembly 17.

The wheel assembly 23 includes an axle 39 and two pairs of horizontally spaced wheels 41 and 43. The axle 39 is fixedly connected beneath a relatively rear portion of beams 25 and 27. The wheels 41 are located just outside of beam 25 and the wheels 43 are located just outside of beam 27. During transportation, the wheels 41 and 43 are the only portion of the pump jack 11 which contacts the ground so that the pump jack is free to roll upon the wheels 41 and 43.

The walking beam 19 of the present invention is an I-beam having a rod connection end 45, a midportion 47 and a drive connection end 49. The rod connection end 45 has a curved head 51 and cables 53 extending along the curved portion of the head 51. The lower end of the cables 53 are connected to a sucker rod clamp 55. As is well known in the art, the curved head 51 and cables 53 provide a proper vertical reciprocating motion to a sucker rod string connected to the clamp 55 in response to rocking motion of the walking beam 19.

The walking beam 19 is pivotally mounted to the support assembly 17 at its midportion 47. This pivotal connection is oriented for rocking the walking beam 19 in the same plane as the longitudinal axis of the box 33.

The drive assembly 15 includes a diesel engine 57, a drive train 59, transmission 61, a pair of drive arms 63 and 65, and a yoke 67. The engine 57 is mounted on top of beams 35 and 37 above front plate 31. The transmission 61 is mounted on beams 35 and 37 between the rear of the beams and the engine 57. The drive train 59 and its housing extend between the engine 57 and the transmission 61.

The drive arms 63 and 65 are journalled by a shaft 69 to the transmission 61. The shaft 69 extends transversely through the transmission 61 with respect to the frame 13. The arms 63 and 65 rotate about shaft 69 in planes parallel to the longitudinal axis of the box 33. Arm 63 rotates just outside of I-beam 25 and drive arm 65 rotates just outside of I-beam 27. The arms 63 and 65 are also aligned with each other in a plane containing their mutual axis of rotation, and remain so aligned at all times during their rotation.

The drive arms 63 and 65 have counterweights 71 and 73 movably attached thereto. The counterweights balance the weight of the sucker rod which is attached to the clamp 55. By moving the counterweights either toward or away from the shaft 69 the counterweight applied as necessary to balance the sucker rod can be varied.

The yoke 67 is journalled to the midportion of each of the arms 63 and 65 for rotation outside of the arms. Opposite the connection to the arms 63 and 65, the yoke 67 is pivotally connected to the drive connection end 49 of the walking beam 19. When the walking beam 19 is in a raised position for pumping, the yoke 67 extends generally downwardly from the walking beam 19 and the transmission 61 is located beneath the drive connection end 49 of walking beam 19.

The transmission 61 has a disc brake for stopping rotation of the arms 63 and 65. A brake lever 74 is mounted on the frame 13 in front of engine 57 and is connected for actuating the brake for the transmission.

The support assembly 17 of the pump jack 11 includes two rear legs 75 and 77 and a front leg 79. These three legs are joined at a base plate 81 upon which is mounted a spindle 83 which forms the pivotal connection to the walking beam 19. The rear legs 75 and 77 are fixedly connected to base plate 81 whereas leg 79 is pivotally connected to base plate 81. The rear legs 75 and 77 are coplanar and are joined by a cross-bar 85 midway along their length. The lower end of legs 75 and 77 are spaced apart and connected pivotally to the rear plate 29 of frame 13. Thus, the legs 75 and 77, the cross-bar 85, and the base plate 81 together form an A-frame which pivots forwardly and backwardly with respect to the elongated box frame 33.

An hydraulic cylinder 87 is connected between the frame 13 and the cross-bar 85 to raise and lower in an arcuate motion the legs 75 and 77, the base plate 81 and the walking beam 19. The hydraulic cylinder 87 is connected at its piston end to the cross-bar 85 and at its cylinder end to a spanning bar which transversely spans the beams 25 and 27 just behind the rear of beams 35 and 37. These connections are pivotal connections to allow the arcuate motion. When the support assembly is lowered it moves forwardly and downwardly in an arcuate motion to make the jack 11 shorter in length and height.

The lower end of front leg 79 can be coupled to and supported by the frame 13 in either of two locations in order to fix the support assembly in a raised, pumping position or in a lowered, transportation position. The frame 13 includes seats 89 and 91 for these two couplings. A coupling pin 93 extends through the lower end of forward leg 79 and either seat 89 or 91 to accomplish the coupling.

Seat 89 is mounted upon the rear of beams 35 and 37 in a raised position approximately the height of the shaft 69. Seat 91 is mounted upon a cross-bar 95 which extends between the lower edges of I-beams 25 and 27 between seat 89 and transmission 61. When the front leg 79 is coupled to the seat 91, the leg 79 extends between I-beams 25 and 27, between I-beams 35 and 37, and between transmission 61 and seat and 89.

The stabilizing assembly 21 includes a front pad 97 and a rear pad 99. Each of these pads have arms 101 and 103 which angle from the pad to a pivotal connection to I-beams 25 and 27 adjacent the cross-bar 95. The arms 101 and 103 are angled to the pads 97 and 99, respectively, such that the pads are horizontal when lowered to a ground level. Hydraulic cylinders 105 and 107 are connected, respectively, between pads 97 and 99 and frame 13. These cylinders raise and lower the pads 97 and 99. The ends of the cylinders 105 and 107 are pivotally connected to allow the raising and lowering motions.

When the pads 95 and 97 have been lowered to engage the ground surface and to stabilize the frame 13, screw jacks 109, 111, 113 and 115 are extended between the edges of the pads and the main frame 13 to provide a fixed and level orientation of the frame 13. Screw jacks 109 and 111 extend between the edges of pad 97 and the front plate 31 while screw jacks 113 and 115 extend between the edges of pad 99 and rear plate 29. For optimum leveling the screw jacks are positioned at the corners of the box 33.

The rear pad 99 comprises a rectangular pad frame 117 of bars from which the arms 103 angularly extend. A flat plate 119 is connected to the bottom of the rectangular pad frame 117 and reinforcing members 121 extend across the interior of the frame. The screw jacks 113 and 115 can be connected to the pad frame or reinforcement bars by chains 123 and 125 and laid within the pad frame during transportation of the pump jack 11. Pad 97 is of similar construction.

To actuate the hydraulic cylinders 87, 105 and 107, three hydraulic valves 116 are mounted on I-beam 27 just behind I-beam 37. A hydraulic pump 118 is mounted on I-beam 35 just beneath engine 57 and supplies hydraulic fluid under pressure through conduits regulated by valves 116. Each of the three valves 116 actuates a different one of the cylinders 87, 105 and 107.

To supply fuel to the diesel engine 57, a fuel tank is disposed in the forward portion of box 33. If more fuel capacity is desired an additional fuel tank can be positioned in the rear portion of box 33. These fuel tanks are connected by fuel lines to the engine 57. By locating the fuel tanks within box 33, they are protected during transportation.

To transport the pump jack 11, drive arms 63 and 65 are rotated to a lowered position and then chained to beams 25 and 27 by chains 129 and 131. These chains have a hook at their free ends which can be hooked through an eyelet at the ends of arms 63 and 65. The arms 63 and 65 extend below box 33 in their lowest point of travel and the chains 129 and 131 extend downwardly from box 33 to hold the arms 63 and 65 in a slightly forward position.

To lower the support assembly 17, the coupling pin 93 is removed and the leg 79 is removed from seat 89. The hydraulic cylinder 87 is actuated to lower the leg 79 into seat 91. Pin 93 is then inserted to fix leg 79 in seat 91. The leg 79 then extends vertically, and is loaded in compression as shown in FIG. 1.

When the support assembly 17 is lowered, yoke 67 comes to rest on a column 133. This positions the walking beam in a low-profile, near horizontal position. Preferably, the height of the walking beam should be minimized by angling the beam to make the highest points on each end horizontal with respect to the ground. Column 133 is mounted upon beam 35 and extends to approximately the height of engine 57.

To raise the pads 97 and 99 for transportation, the screw jacks 109, 111, 113 and 115 are removed from between the frame 13 and their respective pads. The screw jacks are the laid in the pad frames. Hydraulic cylinders 105 and 107 are actuated to raise pads 105 and 107. Of course, the front of the pump jack 11 must be either blocked or connected to a towing vehicle when the front pad 97 is raised.

To connect the pump jack to a towing vehicle, the towing vehicle is moved so that a towing hitch can be received by the front of beams 35 and 37. Preferably, the front of beams 35 and 37 is equipped with a standard receptacle of the type used on commercial trailers.

With the above preparations the portable pump jack of the present invention can be quickly transported by a towing vehicle to almost any well location. The walking beam in the lowered position is sufficiently low to travel beneath most bridges. All of the moving elements of the pump jack are secured while being retained as a single unit. The elongated nature of the pump jack is such that it can travel over roads without the hazard of being over-wide.

During transportation a typical walking beam pump jack constructed in accordance with the present invention is approximately 8 feet wide, 28 feet long and 13½ feet tall. When raised to a pumping position the walking beam is 15 feet tall at its midportion and 18 feet tall at its highest stroke.

The rear plate 29 can have lights mounted thereon for signalling stopping and turning. These lights are standard for all vehicles and can be connected for actuation to a towing vehicle by means of standard cables which extend through the box 33 and the forward end of beams 35 and 37.

To prepare the pump jack 11 for pumping after transportation, the pads 97 and 99 are lowered; the screw jacks 109, 111, 113 and 115 are positioned and extended to level the frame; the support assembly 17 is raised and leg 79 is coupled to seat 89; and chains 129 and 131 are unhooked. These steps are essentially the reverse of the steps required to prepare for transportation.

Both preparation for transport and preparation for pumping are quickly achieved because the heavy equipment procedures are accomplished by hydraulic cylinders. The cylinders and the pump jack are all powered by a single, self-contained engine.

From the above description it can be seen that the portable walking beam pump jack of the present invention is well adapted to attain the objects and advantages mentioned as well as those inherent therein. While presently preferred embodiments of the invention have been described for the purpose of this disclosure, numerous changes in the construction and the arrangement of parts can be made by those skilled in the art, which changes are encompassed within the spirit of this invention as defined by the appended claims.

What is claimed is:

1. A walking beam pump jack comprising:

a substantially horizontally extending frame having a front end and a rear end;

ground engaging wheel means connected to said frame for supporting said frame during transportation over a ground surface, said ground engaging wheel means including a pair of horizontally spaced wheels;

stabilizing means for securing said frame with respect to a ground location, said stabilizing means comprising:

a front pad and a rear pad hydraulically extending from said frame to a ground surface location;

first and second screw jacks extending between said front and rear pads, respectively, and said frame; and first and second pad arms, said first pad arm extending from said frame to said first pad and having one end pivotally connected to said frame, and said second pad arm extending from said frame to said second pad and having one end pivotally connected to said frame;

a walking beam having a first end, a mid-portion and a second end, said second end being adapted for connection to a pumping rod;

counterweighted, rotating driving means mounted on said frame and connected to said first end of said walking beam for rocking said walking beam in a pumping motion, said counterweighted, rotating driving means being rotatable between an elevated pumping position and a lowered transport position while remaining connected to said first end of said walking beam and while said walking beam is lowered from a pumping position elevated relative to said frame to a lowered transport position which is relatively lower in relation to said frame than said elevated pumping position, said counterweighted, rotated driving means including a pair of counterweighted drive arms journaled for rotation about a horizontal axis with said drive arms aligned with each other to concurrently occupy a common plane containing said axis of rotation, and said alignment of said drive arms being maintained at all points during the concurrent rotation of said counterweighted drive arms;

a support assembly foldably mounted on said frame and upon which said mid-portion of said walking beam is pivotally connected, said support assembly being foldable from a first, fixed position in which said walking beam is pivotally supported in a relatively elevated raised, fixed position above said frame for rocking in a pumping motion while in said raised first, fixed position, to a second, relatively lower fixed position in which said walking beam is held is a lowered position relative to said frame for transportation, the movement of said walking beam between said first and second positions causing a concurrent movement between first and second positions by said counterweighted, rotating driving means which remains connected thereto during said movement; and hydraulic cylinder means connected between said frame and said support assembly for moving said support assembly between said first position and said second position thereof, and concurrently causing movement between its respective first position and said transport position of said counterweighted, rotating driving means connected to said first end of said walking beam.

2. A portable walking beam pump jack for use in pumping liquids from an oil well, comprising:

an elongated frame having a longitudinal axis and front and rear ends;

a towing receptacle extending from the front end of said frame for connecting said frame to a towing vehicle;

axle means connected to said frame;

ground engaging wheels connected to said axle means for supporting said frame for rolling transportation;

stabilizing means for securing said frame with respect to a ground location, said stabilizing means comprising:

a rear rectangular pad;

a forward rectangular pad;

hydraulic piston and cylinder means connected between each of said rear and forward pads and said frame for independently hydraulically extending said forward and rear pads downwardly into contact with the ground surface; and a first screw jack connected between said forward pad and said frame for fixing said forward pad in an extended position in engagement with the ground surface; and a second screw jack connected between said rear pad and said frame for fixing said rear pad in an extended position in engagement with the ground surface, said pads being adapted to permit with screw jacks to be contained in, and carried by, said pads when said screw jacks are not in use for fixing the forward and rear pads in the extended positions for purposes of stabilizing and securing said frame;

a walking beam having a first end, a mid-portion and a second end, said second end being adapted for connection to a pumping rod;

an engine mounted on said frame;

a pair of counterweighted drive arms journaled for rotation in parallel planes adjacent said frame, and parallel to said longitudinal axis of said frame, and connected to said engine for rotation for responsive to said engine, said counterweighted drive arms being aligned with each other in a plane containing the common axis of rotation of both of said drive arms, with said alignment of said drive arms being maintained throughout the rotation of said drive arms;

a drive yoke extending from said drive arms to said first end of said walking beam, rotation of said arms thereby driving said walking beam in a rocking, pumping motion when said walking beam is supported at its mid-portion for such rocking motion, said engine, counterweighted arms and drive yoke being mounted on said frame in relation to said walking beam so that said walking beam can be elevated to a pumping position relative to said frame, or lowered relative to said frame to a transport position thereon which is substantially below said elevated pumping position, said walking beam being substantially horizontally disposed in said lowered transport position, wherein said walking beam is continuously connected to said drive yoke which remains continuously connected to said drive arms as said walking beam undergoes movement between said elevated pumping position and said lowered transport position during the use and operation of said walking beam pump jack; and a support assembly foldably mounted on said frame and upon which said mid-portion of said walking beam is pivotally connected, said support assembly being foldable from a first, fixed, pumping position in which said walking beam and the drive arms and drive yoke connected thereto are pivotally supported in a raised position for rocking in a pumping motion, to a second, fixed position in which said walking beam, and the drive arms and drive yoke connected thereto are held in a lowered position for transport;

means for hydraulically moving said support assembly between said first position and said second position.

3. A portable walking beam pump jack for use in pumping liquids from an oil well, comprising:

an elongated frame having a longitudinal axis and having a front end and a rear end, said frame also including first and second vertically spaced support seats located between said front end and said rear end of said frame;

towing means extending from one end of said frame for connecting said frame to a towing vehicle;

an axle extending transversely across said frame;

ground engaging wheels connected to said axle for supporting said frame for rolling transportation;

stabilizing means for securing said frame with respect to a ground location, said stabilizing means comprising:

a front pad and a rear pad each hydraulically extendable from said frame to said ground surface location;

first and second screw jacks extending between said front and said rear pads, respectively, and said frame; and first and second pad arms, said first pad arm extending from said frame to said first pad, and having one end pivotally connected to said frame, and said second pad arm extending from said frame to said second pad, and having one end pivotally connected to said frame;

a walking beam having a first end, a mid-portion and a second end, said second end being adapted for connection to a pumping rod;

a prime mover mounted on said frame;

a pair of arms counterweighted for balancing a pumping rod connected to said walking beam and journalled for rotation in parallel planes adjacent said frame and parallel to said longitudinal axis of said frame, and connected to said prime mover for rotation responsive to said prime mover;

a drive yoke extending from said drive arms to said walking beam at a location spaced from said second end thereof, rotation of said arms thereby driving said walking beam in a rocking motion;

a support assembly foldably mounted on said frame and upon which said walking beam is pivotally connected, said support assembly, said arms and said drive yoke being foldable together from a first position in which said walking beam arms and yoke are supported in a raised position for rocking in a pumping motion, to a second position disposed downwardly and forwardly from said first position and in which said walking beam arms and yoke are held in a lowered position for transportation, said support assembly including:

a rear support having first and second ends, said first end of said rear support being connected to said walking beam at a location between said second end of the walking beam and the point therealong at which said drive yoke is connected, and said second end of said rear support being pivotally connected to said rear end of said frame for pivotal, arcuate movement of said rear support in a plane generally parallel to said longitudinal axis of said frame; and a front support having first and second ends, said first end of said front support being connected to said walking beam at a location between said second end of said walking beam and the point therealong at which said drive yoke is connected, said second end of said front support being movable between said first support seat for holding said support assembly in said first position and said second seat for holding said support assembly in said second position; and hydraulic cylinder means connected between said frame and said support assembly for moving said support assembly between said first position and said second position.

4. A portable walking beam pump jack for use in pumping liquids from a well, comprising:

an elongated frame having a longitudinal axis and having a front end and a rear end, said frame also including a first support seat vertically spaced from said frame, and a second support seat vertically spaced from said frame and located between the front end and the rear end of said frame;

means at one end of said frame facilitating connection of said frame to a towing machine;

axle means connected to said frame and including parts disposed at opposite sides thereof;

ground engaging wheels connected to said axle means at opposite sides of said frame for supporting said frame above of ground for rolling transportation;

stabilizing means for securing said frame with respect to a ground location, said stabilizing means comprising:

a front pad and a rear pad, each of said pads being hydraulically extendable from said frame to said ground location;

screw jack means extending between said frame and said front and rear pads; and first and second pad arms, said first pad arm extending from said frame to said first pad, and having one end pivotally connected to said frame to permit said first pad arm to be pivoted toward and away from said frame, and said second pad arm extending from said frame to said second pad and having one end pivotally connected to said frame for moving said second pad toward and away from said frame;

a walking beam having a first end, a mid-portion and a second end, said second end being adapted for connection to a pumping rod, and said mid-portion being adapted for connection to a supporting assembly for supporting the walking beam at an elevated location above the frame;

a prime mover mounted on said frame;

drive arm means connected to said prime mover for rotation responsive to said prime mover, said drive arm means being counterweighted for balancing a pumping rod connected to said walking beam and journalled for rotation about a horizontal axis extending substantially transversely with respect to said frame;

a drive yoke connected to and extending from said drive arm means to said walking beam at a location spaced from said second end thereof, rotation of said drive arm means thereby acting through said drive yoke to drive said walking beam in a rocking motion;

a support assembly foldably mounted on said frame and upon which said walking beam is pivotally connected, said support assembly, said drive arm means and said drive yoke being foldable together from a first, pumping position in which said walking beam, drive arm means and yoke are supported in a raised position for rocking in a pumping motion, to a second, transport position disposed downwardly and forwardly from said first position, and in which said walking beam, drive arm means and yoke are held in a lowered position for transportation, said support assembly including:

a rear support having first and second ends, said first end of said rear support being connected to said walking beam at a location between said second end of said walking beam and the point therealong at which said drive yoke is connected, and said second end of said rear support being pivotally connected to said rear end of said frame for pivotal, arcuate movement of said rear support in a plane generally parallel to said longitudinal axis of said frame; and a front support having first and second ends, said first end of said front support being connected to said walking beam at a location between said second end of said walking beam and the point therealong at which said drive yoke is connected, said second end of said front support being movable between said first support seat for holding said support assembly in said first, pumping position, and said second seat for holding said support assembly in said second, transport position; and hydraulic means connected between said frame and said support assembly for moving said support assembly between said first, pumping position and said second, transport position and concurrently moving said drive yoke and said drive arm means between said first and second positions while the same remain connected to said walking beam.

5. A walking beam pump jack comprising:

a main frame having a front end and a rear end;

ground engaging wheel means connected to said frame for supporting said frame during transportation over a ground surface, said wheel means including a pair of horizontally spaced ground engaging wheels;

stabilizing means for securing said frame with respect to a ground location, said stabilizing means comprising:

a forward pad comprising:

a rectangular forward pad frame having a length at least as great as the distance between said spaced ground engaging wheels;

a flat plate secured across said rectangular forward pad frame and forming a receptacle therewith;

a forward pad frame hydraulic piston and cylinder subassembly connected between the center of said main frame at the forward end thereof, and the center of said forward rectangular pad frame; and a pair of forward pad frame screw jacks disposed on opposite sides of the forward pad frame hydraulic piston and cylinder subassembly, said forward pad frame screw jacks being horizontally spaced and positioned to extend upwardly to the opposite outer sides of said main frame from the opposite outer side portions of said forward rectangular pad frame;

a rectangular rear pad frame disposed beneath the rear portion of said main frame and having a length as great as the distance between said horizontally spaced ground-engaging wheels;

a rear pad hydraulic piston and cylinder subassembly connected between the center of the rear of said main frame and the center of said rear rectangular pad frame;

a pair of rear pad screw jacks disposed on opposite sides of the rear pad hydraulic piston and cylinder subassembly, said rear screw jacks being horizontally spaced from each other and each extending upwardly so that the screw jacks contact the opposite outer sides of said main frame and extend downwardly to the outer side portions of said rectangular rear pad frame;

a first forward pad arm extending from said main frame downwardly and forwardly to said forward rectangular pad frame, and having one end pivotally connected to said main frame, and a second end connected to said forward rectangular pad frame; and a rear pad arm extending downwardly and rearwardly from said main frame to said rectangular rear pad frame and having an end pivotally connected to said main frame and second end connected to said rear rectangular pad frame;

a walking beam having a first end, a mid-portion and a second end, said second end being adapted for connection to a pumping rod;

counterweighted, rotating driving means mounted on said frame and connected to said first end of said walking beam for rocking said walking beam in a pumping motion, said counterweighted, rotating driving means driving rotatable between an elevated pumping position and a lowered transport position while remaining connected to said first end of said walking beam and while said walking beam is lowered from a pumping position elevated relative to said frame to a lowered transport position which is relatively lower in relation to said frame than said elevated pumping position, said counterweighted, rotated driving means including a pair of counterweighted drive arms journaled for rotation about a horizontal axis with said drive arms aligned with each other to concurrently occupy a common plane containing said axis of rotation, and said alignment of said drive arms being maintained at all points during the concurrent rotation of said counterweighted drive arms;

a support assembly foldably mounted on said frame said upon which said mid-portion of said walking beam is pivotally connected, said support assembly being foldable from a raised, first, fixed position in which said walking beam is pivotally supported in a relatively elevated, raised, fixed position above said frame for rocking in a pumping motion while in said raised first, fixed position, to a second, relatively lower, fixed position in which said walking beam is held in a lowered position relative to said frame for transportation, the movement of said walking beam between said first position and said second positions causing a concurrent movement between said first and second positions by said counterweighted, rotating driving means which remains connected thereto during said movement; and hydraulic cylinder means connected between said frame and said support assembly for moving said support assembly between said first position and said second position thereof, and concurrently causing movement between its respective first position and said transport position of said counterweighted, rotating driving means connected to said first end of said walking beam.

6. A portable walking beam pump jack for use in pumping liquids from a well, comprising:

an elongated frame having a longitudinal axis and having a front end and a rear end;

means at the front end of the frame facilitating connection of the frame to a towing machine;

axle means connected to said frame and including parts disposed at opposite sides of the frame;

ground-engaging wheels connected to said axle means at opposite sides of the frame for supporting said frame above the ground for rolling transportation;

stabilizing means for securing said frame with respect to a ground location, said stabilizing means comprising:

a front pad and a rear pad, each of said pads being hydraulically extendable from said frame to said ground location;

screw jack means extending between said frame and said front and rear pads; and first and second pad arms, said first pad arm extending from said frame to said first pad, and having one end pivotally connected to said frame to permit said first pad arm to be pivoted toward and away from said frame, and said second pad arm extending from said frame to said second pad and having one end pivotally connected to said frame for moving said second pad toward and away from said frame;

a walking beam having a first end, a mid-portion and a second end, said second end being adapted for connection to a pumping rod, and said mid-portion being adapted for connection to a supporting assembly for supporting the walking beam at an elevated location above the frame;

a prime mover mounted on said frame;

drive arm means connected to said prime mover for rotation responsive to said prime mover, said drive arm means being counterweighted for balancing a pumping rod connected to said walking beam and journaled for rotation about a horizontal axis extending substantially transversely with respect to said frame;

a drive yoke connected to, and extending from, said drive arm means to said walking beam at a location spaced from said second end thereof, rotation of said drive arm means thereby acting through said drive yoke to drive said walking beam in a rocking motion;

a support assembly foldably mounted on said frame and upon which said walking beam is pivotally connected, said support assembly, said drive arm means and said drive yoke being foldable together from a first, pumping position in which said walking beam, drive arm means and yoke are supported in a raised position for rocking in a pumping motion with said second end of said walking beam projecting beyond the rear end of said elongated frame, to a second, lowered transport position disposed downwardly and from said first position, and in which said walking beam, drive arm means and yoke are held in a lowered position for transportation with said walking beam extending substantially horizontally, said support assembly including:

an elongated rear support having first and second ends, said first end of said rear support being connected to said walking beam at a location between said second end of said walking beam and the point therealong at which said drive yoke is connected, and said second end of said rear support being pivotally connected to said frame for pivotal, arcuate movement of said rear support in a plane generally parallel to said longitudinal axis of said frame; and an elongated front support having first and second ends, said first end of said elongated front support being connected to said walking beam at a location between said second end of said walking beam and the point along said walking beam at which said drive yoke is connected, said second end of said front support being movable from a first supporting position in which said walking beam is in said raised position for rocking in a pumping motion, and in which said elongated front support extends at an angle to the vertical, to a second supporting position in which said front support extends vertically directly between said frame and said walking beam, and in which said walking beam is in said lowered transport position and extends substantially horizontally; and hydraulic means connected between said frame and said support assembly for moving said support assembly between said first, pumping position and said second, transport position, and concurrently moving said drive yoke and said drive arm means between said first and second positions, while the same remain at all times connected to said walking beam.

* * * * *

UNITED STATES PATENT AND TRADEMARK OFFICE

CERTIFICATE OF CORRECTION

PATENT NO. : 4,788,873

DATED : December 6, 1988

INVENTOR(S) : Roy N. Laney

It is certified that error appears in the above-identified patent and that said Letters Patent are hereby corrected as shown below:

In the Specification:

In Column 3, line 57, after the word "a" insert -main-.

In Column 4, line 1, after the word "first" insert -fixed-.

In the Claims:

In Column 7, line 64 delete "extending" and insert -extendable-.

In Column 9, line 15, delete "with" and insert -said-.

Signed and Sealed this

Twenty-eighth Day of March, 1989

*Attest:*

DONALD J. QUIGG

*Attesting Officer*

*Commissioner of Patents and Trademarks*